US005240521A

United States Patent [19]

Crum et al.

[11] Patent Number: 5,240,521

[45] Date of Patent: Aug. 31, 1993

[54] HEAT TREATMENT FOR DISPERSION STRENGTHENED ALUMINUM-BASE ALLOY

[75] Inventors: James R. Crum, Ona, W. Va.; Robert D. Schelleng, Wakefield, R.I.; James McEwen; John H. Weber, both of Huntington, W. Va.

[73] Assignee: Inco Alloys International, Inc., Huntington, W. Va.

[21] Appl. No.: 729,473

[22] Filed: Jul. 12, 1991

[51] Int. Cl.[5] ..... C22F 1/04

[52] U.S. Cl. ..... 148/688; 148/415; 148/440; 148/702; 420/542

[58] Field of Search ..... 148/11.5 A, 159, 415, 148/440, 688, 702; 420/542

[56] References Cited

U.S. PATENT DOCUMENTS

| | | | |
|---|---|---|---|
| 4,292,079 | 9/1981 | Pickens et al. | 75/232 |
| 4,389,241 | 6/1983 | Schelleng | 420/590 |
| 4,409,038 | 10/1983 | Weber | 148/12.7 A |
| 4,532,106 | 7/1985 | Pickens | 420/528 |
| 4,594,222 | 6/1986 | Heck et al. | 148/415 |
| 4,600,556 | 7/1986 | Donachie et al. | 420/542 |
| 4,643,780 | 2/1987 | Gilman et al. | 148/12.7 A |
| 4,758,273 | 7/1988 | Gilman et al. | 75/249 |

FOREIGN PATENT DOCUMENTS

| | | |
|---|---|---|
| 0142261 | 5/1985 | European Pat. Off. . |
| 0227563 | 7/1987 | European Pat. Off. . |
| 1927500 | 2/1971 | Fed. Rep. of Germany . |

OTHER PUBLICATIONS

M. Fridlyander et al., "New Light Alloys of Aluminum with Lithium and Magnesium", Metallovedenie i Termicheskaya Obrabotka Metallov, Nov. 3, pp. 50-52 (Mar. 1968).

Thompson et al., "Precipitation Characteristics of Aluminum-Lithium Alloys Containing Magnesium" Journal of the Institute of Metals, vol. 101, pp. 111-115, (1973).

Sanders et al., "Aluminum-Lithium Alloys: Low Density," Metals Progress, pp. 32-37, (Mar. 1978).

D. Webster, "Properties and Microstructure of Aluminum-Copper-Magnesium-Lithium Alloys," vol. 10A Metallurgical Transactions pp. 1713-1721, (Dec. 1979).

Niskanen et al., "Corrosion of Aluminum Alloys Containing Lithium," Corrosion Science, vol. 22, No. 4, pp. 283-304, (1982).

Christodoulou et al., "Stress-Corrosion Cracking in Al-Li Binary Alloys," Alum.-Lithium Alloys, Proc. Int. Alum.-Lithium Conf., 2nd pp. 561-579 (1984).

Berezina et al., "Increasing the Corrosion Resistance of Extrusions of Alloy 01242," Metalloved. Term. Obrab. Met (9) pp. 55-58, (1985).

Baumert et al., "Effect of Heat Treating on Corrosion Resistance of Al-Mg-Li Alloy," Aluminum-Lithium Alloys 3, Proc. Intl. Alum.-Lithium Conf., 3rd pp. 282-286 (1986).

Sharma et al., "Localized Corrosion of Al-Li Alloys," J. Electrochem. Soc. India pp. 79-81 (1989).

*Primary Examiner*—R. Dean

*Assistant Examiner*—Robert R. Koehler

*Attorney, Agent, or Firm*—Blake T. Biederman; Edward A. Steen

[57] ABSTRACT

The invention provides a method for heat treating aluminum-base alloys. The method increases stress corrosion resistance after heating of the alloy to temperatures between 100° C. and 150° C. A dispersion strengthened aluminum-base alloy containing lithium and magnesium is shaped to form an object of substantially final form. The dispersion strengthened aluminum-base alloy is heated to a temperature between 160° C. and 250° C. for at least 3 hours. The heat treated object has increased stress corrosion resistance after exposure to temperatures between 100° C. and 150° C.

5 Claims, 1 Drawing Sheet

HEAT TREATMENT FOR DISPERSION STRENGTHENED ALUMINUM-BASE ALLOY

FIELD OF INVENTION

This invention relates to a heat treatment for improving properties of dispersion strengthened aluminum-base alloys. In particular, this invention relates to improving stress corrosion resistance of dispersion strengthened aluminum-base alloys containing magnesium and lithium after exposure to slightly elevated temperatures, e.g. 100° C. to 150° C.

BACKGROUND OF THE INVENTION

It has been discovered that mechanically alloyed (MA) dispersion strengthened alloys may become sensitized to stress corrosion cracking at room temperature after being heated to temperatures of about 100° C. to 150° C. or above. Samples of IncoMAP® alloy AL-905 XL (IncoMAP® is a registered trademark of the Inco family of companies), an aluminum-base MA dispersion strengthened alloy containing magnesium and lithium designed to replace alloys such as 7075-T73 in forgings where weight is critical. Samples of alloy AL-905XL, were forged, aged at 100° C. for 336 hours and air cooled. It has been found that these dispersion strengthened aluminum-base alloys become sensitized to stress corrosion upon aging at 100° C. After this 100° C. heat treatment, samples, stressed typically at 75 percent of the yield strength, cracked after as few as 1 or 2 days in 3.5% sodium chloride. A 20 day period without cracking is a typical minimum requirement for dispersion strengthened alloys containing lithium and magnesium. It is an object of this invention to provide a method for protecting aluminum-base dispersion strengthened alloys from stress corrosion cracking after being exposed to temperatures of about 100° C. to 150° C.

SUMMARY OF THE INVENTION

The invention provides a method for heat treating aluminum-base alloys. The method increases stress corrosion resistance after heating of the alloy to temperatures of between about 100° C. and 150° C. A dispersion strengthened aluminum-base alloy containing lithium and magnesium is shaped to form an object of substantially final form. The object is heated to a temperature between about 160° C. and 250° C. for at least 3 hours. The heat treated alloy has increased stress corrosion resistance after exposure to temperatures between about 100° C. and 150° C.

DESCRIPTION OF PREFERRED EMBODIMENT

Figure 1:
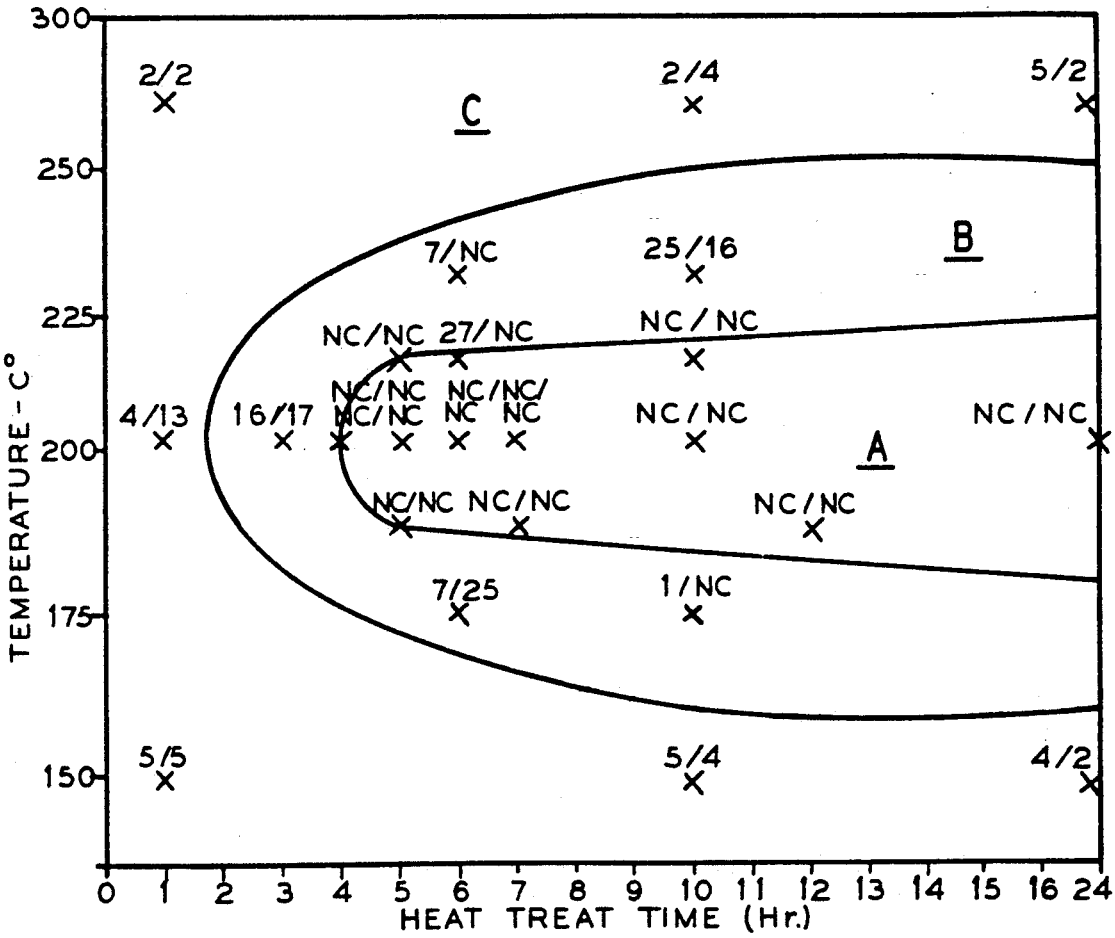
FIG. 1 is a plot of stress corrosion resistance after sensitization at 121° C. expressed in time to failure in days, as a function of heat treatment time and temperature.

The invention provides an effective method for decreasing sensitization to stress corrosion cracking from exposure to environments at temperatures of 100° C. to 150° C. or above. Dispersion strengthened aluminum base alloys containing magnesium and lithium are preferably treated at temperatures between about 160° C. and 250° C. for at least 3 hours. This heat treatment has been found to protect against stress corrosion cracking resulting from sensitization produced by 120° C. environments. Most advantageously, alloys are heat treated at temperatures between about 190° C. and 220° C. for at least five hours. In particular, the heat treatment is advantageously used for alloys containing by weight percent about 0.5 to 3 lithium and about 0.5 to 7 magnesium. All values in this specification are expressed in weight percent unless specifically expressed otherwise. It is noted that leaner combinations of lithium and magnesium may not be subject to sensitization from exposure to temperatures of 100° C. to 150° C. Most advantageously, the aluminum-base alloy is mechanically alloyed containing about 0.2 to 2.5% carbon and about 0.25 to 1.5% oxygen. Iron, silicon and other incidental impurities may also be present in the dispersion strengthened aluminum-base alloy. Dispersion strengthened alloys of the invention are advantageously produced by mechanical alloying in accordance with U.S. Pat. No. 3,740,210. Specific examples of mechanically alloyed aluminum-base alloys and processes for producing the alloys are found in U.S. Pat. Nos., 4,389,241, 4,409,038, 4,532,106, 4,594,222, 4,600,556, 4,643,780 and 4,758,273. Advantageously, the aluminum-base MA dispersion strengthened alloy used is IncoMAP® alloy AL-905XL.

EXAMPLE

Samples of alloy AL-905XL were prepared for mechanical and corrosion testing. Samples tested had the following composition expressed in weight percent given below in Table 1.

TABLE 1

| | |
|---|---|
| Magnesium | 3.98 |
| Lithium | 1.31 |
| Carbon | 1.18 |
| Oxygen | 0.31 |
| Iron | 0.13 |
| Silicon | 0.07 |
| Aluminum | Balance |

A total of 54 samples were prepared to test several heat treatments. Sample material was side forged at a temperature of 343° C. from 15.2 cm diameter rounds samples to a thickness of 5.7 cm. Four 5.72 cm by 5.72 cm by 22.9 cm pieces were cut from the side forged material. From these four pieces, four 5.1 cm diameter tubes having a 22.9 cm length and a 0.645 cm wall thickness were machined. From these tubes, C-Rings were cut in a short transverse direction. Duplicate C-Rings for each time and temperature studied were cut, heat treated and stressed to 45 ksi prior to testing.

Samples were tested in a 3.5% NaCl alternate immersion test in accordance with ASTM G44-88 (except relative humidity varied between 20% and 78% during the test periods). The testing cycle consisted of a 10 minute immersion in the NaCl solution followed by a 50 minute air drying every hour for the test duration. All specimens were examined daily for cracking and the test environment was renewed weekly. Heat treatments and time to failure for each sample tested are given in Table 2 below.

TABLE 2

| Heat Treatment | Time to Failure (days) |
|---|---|
| 260° C./1 hr., A.C. + 121° C./100 hrs., A.C. | 2, 2 |
| 260° C./10 hrs., A.C. + 121° C./100 hrs., A.C. | 2, 4 |
| 260° C./24 hrs., A.C. + 121° C./100 hrs., A.C. | 5, 2 |
| 232° C./6 hrs., A.C. + 121° C./100 hrs., A.C. | 7, NC |

TABLE 2-continued

| Heat Treatment | Time to Failure (days) |
|---|---|
| 232° C./10 hrs., A.C. + 121° C./100 hrs., A.C. | 25, 26 |
| 218° C./5 hrs., A.C. + 121° C./100 hrs., A.C. | NC, NC |
| 218° C./6 hr., A.C. + 121° C./100 hrs., A.C. | 27, NC |
| 218° C./10 hrs., A.C. + 121° C./100 hrs., A.C. | NC, NC |
| 204° C./1 hrs., A.C. + 121° C./100 hrs., A.C. | 13, 4 |
| 204° C./3 hrs., A.C. + 121° C./100 hrs., A.C. | 16, 17 |
| 204° C./4 hrs., A.C. + 121° C./100 hrs., A.C. | NC, NC |
| 204° C./5 hrs., A.C. + 121° C./100 hrs., A.C. | NC, NC |
| 204° C./6 hrs., A.C. + 121° C./100 hrs., A.C. | NC, NC |
| 204° C./7 hrs., A.C. + 121° C./100 hrs., A.C. | NC, NC |
| 204° C./10 hr., A.C. + 121° C./100 hrs., A.C. | NC, NC |
| 204° C./24 hrs., A.C. + 121° C./100 hrs., A.C. | NC, NC |
| 190° C./5 hrs., A.C. + 121° C./100 hrs., A.C. | NC, NC |
| 190° C./6 hrs., A.C. + 121° C./100 hrs., A.C. | NC, NC |
| 190° C./12 hrs., A.C. + 121° C./100 hrs., A.C. | NC, NC |
| 177° C./6 hrs., A.C. + 121° C./100 hrs., A.C. | 25, 7 |
| 177° C./10 hrs., A.C. + 121° C./100 hrs., A.C. | 7, NC |
| 149° C./1 hrs., A.C. + 121° C./100 hrs., A.C. | 5, 5 |
| 140° C./10 hrs., A.C. + 121° C./100 hrs., A.C. | 5, 4 |
| 140° C./24 hrs., A.C. + 121° C./100 hrs., A.C. | 4, 2 |
| As Forged + 100° C./336 hrs., A.C. | 1, 2 |
| As Forged + 100° C./336 hrs., A.C. | 5, 7 |
| As Forged + 121° C./100 hrs., A.C. | 5, 5 |

*NC designates no cracking and A.C. indicates air cooling.

All samples tested had properties equal to or improved over "as forged" test samples given a sensitization treatment at 100° C. or 121° C. FIG. 1 plots time to failure in days with NC designating no cracking after 30 days of exposure. Referring to FIG. 1, regions A and B of time and temperature significantly increase stress corrosion cracking resistance at room temperature after being sensitized at 121° C. Region C had little or no increase in stress corrosion cracking resistance. From FIG. 1, a heat treatment of at least 3 hours appears at about 204° C. to be the most advantageous. Furthermore, from FIG. 1 the advantageous heat treatment range of 160° C. to 250° C. for region B and the most advantageous range of 190° C. to 220° C. for region A are readily apparent. Heat treatments have increased stress corrosion cracking life (after being exposed to temperatures of 100° C. to 150° C.) from cracking in 1 to 2 days to no cracking after 30 days exposure. Advantageously, alloys of the invention are heat treated directly in an "as worked" condition. For purposes of the invention "as worked" defines a condition following a hot or cold working operation such as rolling, forging, hot isostatic pressing and extrusion without a solution treatment. Alloys of the invention do not require a solutionizing heat treatment. A solutionizing heat treatment for purposes of the invention is defined as a high temperature heat treatment that dissolves precipitates and/or precipitate precursors which may be present. After heat treatments of the invention, exposure to solutionizing temperatures will likely reverse beneficial stress corrosion resistance. Thus, since alloys of the invention are typically worked at high temperatures, alloys are preferably heat treated in a substantially final form such as an "as forged" condition.

Additional samples were machined for mechanical testing in accordance with ASTM B557-84. Samples tested having the composition of Table 1 had the following mechanical properties in the as forged condition.

TABLE 3

Mechanical Properties of As Forged IncoMAP alloy AL-905XL.

| Specimen Orientation | Yield Strength (MPa) | Tensile Strength (MPa) | % Elong. | % Red. Area |
|---|---|---|---|---|
| Long Transverse | 413 | 495 | 7.4 | 8.6 |
| Longitudinal | 463 | 524 | 12.0 | 17.9 |
| Short Transverse | 425 | 487 | 7.4 | 9.7 |

Longitudinal samples of IncoMAP® alloy AL-905XL were tested for comparing mechanical properties of as forged condition material to mechanical properties of material in an as forged plus a heat treatment of 204° C. for 10 hours condition. Mechanical properties of as forged and as forged +204° C./10 hrs./A.C. IncoMAP alloy AL-905XL are given below in Table 4.

TABLE 4

| Specimen Orientation | Yield Strength (MPa) | Tensile Strength (MPa) | % Elong. | % Red. Area |
|---|---|---|---|---|
| (As Forged) Longitudinal | 461 | 529 | 9.0 | 18.0 |
| (204° C./10 Hr/A.C.) Longitudinal | 434 | 516 | 7.5 | 10.0 |

In addition, Table 5 compares fracture toughness of the composition of Table 1 in the as forged condition to material forged and given a 10 hour 204° C. heat treatment followed by air cooling.

TABLE 5

| Specimen Orientation | Heat Treated | $K_{1c}$ (MPa · $m^{\frac{1}{2}}$) |
|---|---|---|
| Short Transverse | Yes | 20.0 |
| Short Transverse | Yes | 22.0 |
| Short Transverse | No | 27.7 |
| Short Transverse | No | 27.1 |

Tables 4 and 5 indicate that tensile properties are minimally affected by the heat treatment of the invention and a good level of fracture toughness is retained. Thus, a heat treatment in the as forged condition of an alloy may provide dramatically improved stress corrosion resistance after sensitization at about 100° C. to 150° C. without a significant loss in mechanical properties.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for treating mechanically alloyed aluminum-base alloys to increase stress corrosion resistance after heating of the aluminum-base alloy to a temperature between about 100° C. and 150° C. comprising the steps of:

shaping a dispersion strengthened aluminum-base alloy consisting essentially of by weight percent about 0.5 to 3 lithium and about 0.5 to 7 magnesium to form an object of substantially final form; and heat treating said object strengthened aluminum-base alloy at a temperature and at least a minimum time as defined by region A of FIG. 1 sufficient to increase stress corrosion cracking resistance to at least 27 days in accordance with ASTM G44-88 for conditions arising from said dispersion strengthened aluminum-base alloy being exposed to temperatures between about 100° C. and 150° C.

2. The method of claim 1 wherein said dispersion strengthened aluminum-base alloy contains by weight percent about 0.2 to 2.5 carbon and about 0.25 to 1.5 oxygen.

3. The method of claim 1 wherein said heating is for at least 5 hours.

4. The method of claim 1 wherein said heat treating of said dispersion strengthened aluminum-base alloy is in an as worked condition and said dispersion strengthened alloy is not solutionized.

5. The object of claim 1 wherein said dispersion strengthened alloy is heat treated at a temperature between about 190° C. and 220° C.

* * * * *